US009998824B2

(12) United States Patent
Kopetz et al.

(10) Patent No.: US 9,998,824 B2
(45) Date of Patent: Jun. 12, 2018

(54) SYSTEM AND METHOD FOR AN ACOUSTIC TRANSDUCER AND ENVIRONMENTAL SENSOR PACKAGE

(71) Applicant: Infineon Technologies AG, Neubiberg (DE)

(72) Inventors: Andreas Kopetz, Munich (DE); Andreas Wiesbauer, Poertschach (AT); Roland Helm, Munich (DE); Christian Mandl, Munich (DE); Arnaud Walther, Unterhaching (DE)

(73) Assignee: INFINEON TECHNOLOGIES AG, Neubiberg (DE)

( * ) Notice: Subject to any disclaimer, the term of this patent is extended or adjusted under 35 U.S.C. 154(b) by 0 days. days.

(21) Appl. No.: 15/620,354

(22) Filed: Jun. 12, 2017

(65) Prior Publication Data

US 2017/0280237 A1 Sep. 28, 2017

Related U.S. Application Data

(62) Division of application No. 14/661,429, filed on Mar. 18, 2015, now Pat. No. 9,706,294.

(51) Int. Cl.

| | |
|---|---|
| ***H04R 3/00*** | (2006.01) |
| ***H04R 19/04*** | (2006.01) |
| ***H04R 19/00*** | (2006.01) |

(52) U.S. Cl.

CPC ..... *H04R 3/00* (2013.01); *H04R 19/005* (2013.01); *H04R 19/04* (2013.01)

(58) Field of Classification Search

CPC ..... H04R 19/005; H04R 19/04; H04R 3/00; H04R 2420/01; H04R 3/007

See application file for complete search history.

(56) References Cited

U.S. PATENT DOCUMENTS

| | | | | |
|---|---|---|---|---|
| 4,295,139 | A * | 10/1981 | Arpino | H04M 11/005 340/870.01 |
| 5,647,834 | A * | 7/1997 | Ron | A61B 5/16 600/23 |
| 5,805,142 | A * | 9/1998 | Byrne | G06F 3/03543 345/157 |
| 9,549,252 | B2 | 1/2017 | Suvanto | |
| 9,560,455 | B2 * | 1/2017 | Miluzzi | H04R 3/005 |
| 2010/0135516 | A1 | 6/2010 | Saiki et al. | |
| 2013/0169442 | A1 * | 7/2013 | Ruocco | B60K 28/063 340/576 |
| 2014/0112510 | A1 | 4/2014 | Yang et al. | |

(Continued)

FOREIGN PATENT DOCUMENTS

| | | | |
|---|---|---|---|
| KR | 101088809 | B1 | 12/2011 |
| KR | 20130047763 | A | 5/2013 |
| KR | 1020130047763 | B1 | 5/2013 |

*Primary Examiner* — Thang Tran

(74) *Attorney, Agent, or Firm* — Slater Matsil, LLP

(57) ABSTRACT

According to an embodiment, a transducer package includes a circuit board including a port, a lid disposed over the port, an acoustic transducer disposed over the port and including a membrane, and an environmental transducer disposed at the circuit board in the port. The lid encloses a first region, and the membrane separates the port from the first region. Other embodiments include corresponding systems, apparatus, and structures, each configured to perform the actions or steps of corresponding embodiment methods.

17 Claims, 8 Drawing Sheets

(56) References Cited

U.S. PATENT DOCUMENTS

| | | | |
|---|---|---|---|
| 2015/0003638 | A1 | 1/2015 | Kasai |
| 2015/0043759 | A1 | 2/2015 | Koji et al. |
| 2015/0078591 | A1 | 3/2015 | Kasai |
| 2015/0158722 | A1 | 6/2015 | Lim et al. |
| 2015/0321906 | A1 | 11/2015 | Tsai et al. |
| 2016/0014528 | A1 | 1/2016 | Kasai |
| 2016/0165330 | A1 | 6/2016 | Minervini et al. |
| 2016/0221822 | A1 | 8/2016 | Krumbein et al. |

* cited by examiner

SYSTEM AND METHOD FOR AN ACOUSTIC TRANSDUCER AND ENVIRONMENTAL SENSOR PACKAGE

CROSS-REFERENCE TO RELATED APPLICATIONS

This application is a divisional of U.S. patent application Ser. No. 14/661,429, filed on Mar. 18, 2015, and entitled "System and Method for an Acoustic Transducer and Environmental Sensor Package," which application is hereby incorporated herein by reference.

TECHNICAL FIELD

The present invention relates generally to a sensors and transducers, and, in particular embodiments, to a system and method for an acoustic transducer and environmental sensor package.

BACKGROUND

Transducers convert signals from one domain to another and are often used in sensors. One common sensor with a transducer that is seen in everyday life is a microphone that converts sound waves to electrical signals. Another example of a common sensor is a thermometer. Various transducers exist that serve as thermometers by transducing temperature signals into electrical signals.

Microelectromechanical system (MEMS) based sensors include a family of transducers produced using micromachining techniques. MEMS, such as a MEMS microphone, gather information from the environment by measuring the change of physical state in the transducer and transferring a transduced signal to processing electronics that are connected to the MEMS sensor. MEMS devices may be manufactured using micromachining fabrication techniques similar to those used for integrated circuits.

MEMS devices may be designed to function as, for example, oscillators, resonators, accelerometers, gyroscopes, pressure sensors, microphones, and micro-mirrors. Many MEMS devices use capacitive sensing techniques for transducing the physical phenomenon into electrical signals. In such applications, the capacitance change in the sensor is converted to a voltage signal using interface circuits.

One such capacitive sensing device is a MEMS microphone. A MEMS microphone generally has a deflectable membrane separated by a small distance from a rigid backplate. In response to a sound pressure wave incident on the membrane, it deflects towards or away from the backplate, thereby changing the separation distance between the membrane and backplate. Generally, the membrane and backplate are made out of conductive materials and form "plates" of a capacitor. Thus, as the distance separating the membrane and backplate changes in response to the incident sound wave, the capacitance changes between the "plate" and an electrical signal is generated.

MEMS microphones are often used in mobile electronics, such as tablet computers or mobile phones. In some applications, it may be desirable to increase the functionality of these MEMS microphones in order to provide additional or improved functionality to the electronic system including the MEMS microphone, such as a tablet computer or mobile phone, for example.

SUMMARY

According to an embodiment, a transducer package includes a circuit board including a port, a lid disposed over the port, an acoustic transducer disposed over the port and including a membrane, and an environmental transducer disposed at the circuit board in the port. The lid encloses a first region, and the membrane separates the port from the first region. Other embodiments include corresponding systems, apparatus, and structures, each configured to perform the actions or steps of corresponding embodiment methods.

BRIEF DESCRIPTION OF THE DRAWINGS

For a more complete understanding of the present invention, and the advantages thereof, reference is now made to the following descriptions taken in conjunction with the accompanying drawings, in which.

Corresponding numerals and symbols in the different figures generally refer to corresponding parts unless otherwise indicated. The figures are drawn to clearly illustrate the relevant aspects of the embodiments and are not necessarily drawn to scale.

DETAILED DESCRIPTION OF ILLUSTRATIVE EMBODIMENTS

The making and using of various embodiments are discussed in detail below. It should be appreciated, however, that the various embodiments described herein are applicable in a wide variety of specific contexts. The specific embodiments discussed are merely illustrative of specific ways to make and use various embodiments, and should not be construed in a limited scope.

Description is made with respect to various embodiments in a specific context, namely acoustic and environmental transducers, and more particularly, MEMS transducers. Some of the various embodiments described herein include MEMS transducer systems, MEMS microphone systems, MEMS environmental transducers, interface circuits for transducers and MEMS transducer systems, and multiple transducer systems including acoustic and environmental transducers. In other embodiments, aspects may also be applied to other applications involving any type of sensor or transducer according to any fashion as known in the art.

A general trend in electronics involves increasing functionality while reducing occupied space. For example, a trend for mobile phones has produced progressively thinner devices with simultaneously increased functionality. According to various embodiments, a transducer package includes an acoustic transducer, an environmental transducer, and a shared integrated circuit (IC) coupled to the acoustic transducer and the environmental transducer inside the transducer package. The environmental transducer may be a temperature sensor, a pressure sensor, a humidity sensor, or a gas sensor, for example. The transducer package may include a plurality of various environmental transducers. Further, both the acoustic transducer and the environmental transducer are formed as MEMS transducers using micromachining techniques. In such embodiments, the IC includes shared processing or interface blocks and the transducer package includes a shared port. Thus, the transducer package may include added functionality while achieving space saving in the electronic system.

Figure 1:
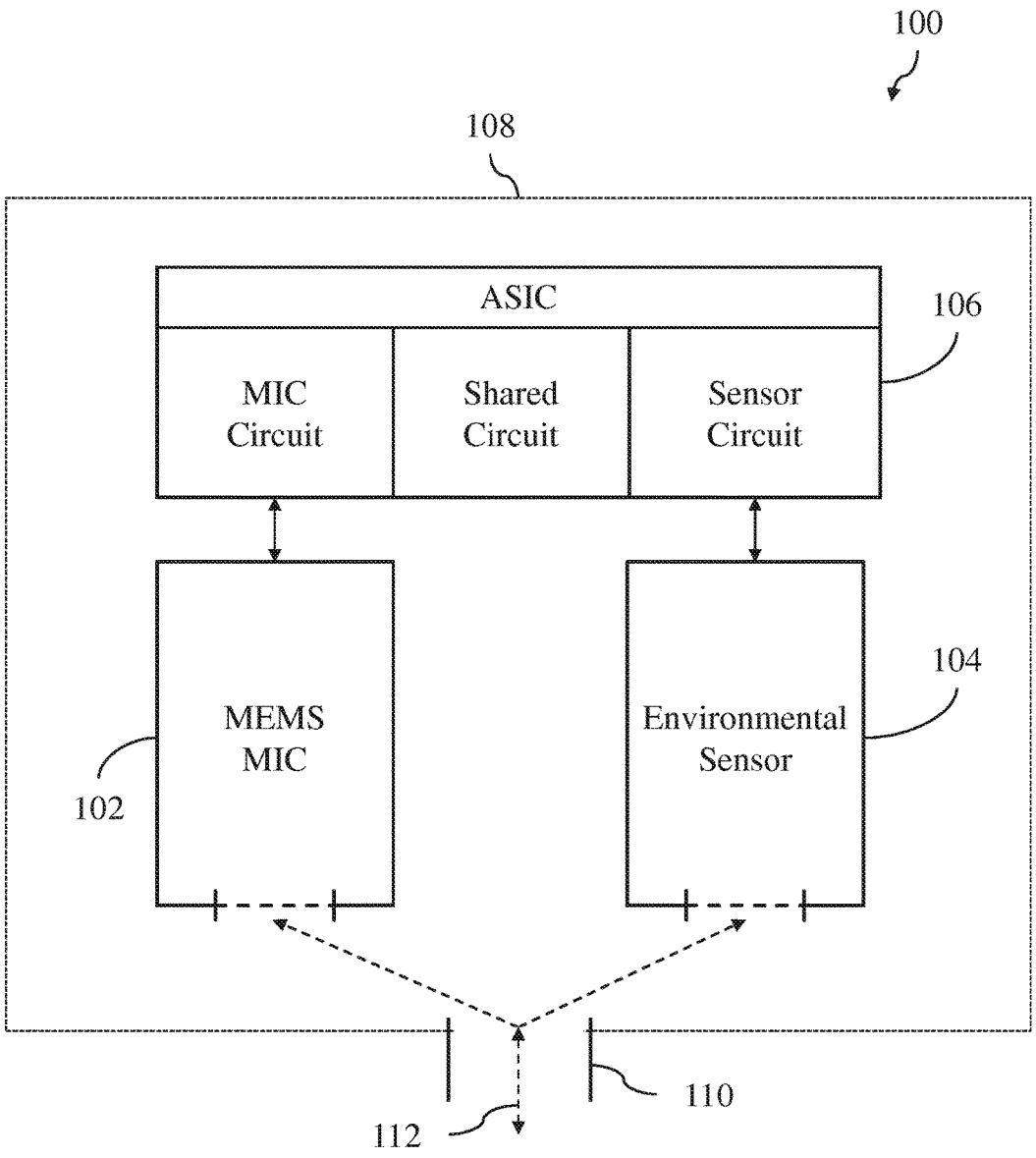
FIG. 1 illustrates a system block diagram of an embodiment transducer package.

FIG. 1 illustrates a system block diagram of an embodiment transducer package 100 including MEMS microphone 102, environmental sensor(s) 104, application specific integrated circuit (ASIC) 106, and case 108 with port 110. According to various embodiments, MEMS microphone 102 and environmental sensor(s) 104 are coupled to the ambient environment by environmental coupling 112 through shared port no in case 108. In various embodiments, the positioning and integration of MEMS microphone 102 and environmental sensor(s) 104 may vary, as described herein below in reference to the other figures.

In various embodiments, ASIC 106 is coupled to MEMS microphone 102 and environmental sensor(s) 104. ASIC 106 includes a dedicated microphone circuit for interfacing with MEMS microphone 102 and a dedicated sensor circuit for interfacing with environmental sensor(s) 104. Further, ASIC 106 includes shared circuit portions for MEMS microphone 102 and environmental sensor(s) 104. In such embodiments, MEMS microphone 102, environmental sensor(s) 104, and ASIC 106 are coupled to a shared circuit board and enclosed by case 108. Port no may be formed in the circuit board or in case 108.

According to various embodiments, environmental sensor(s) 104 includes a plurality of environmental sensors including any of a temperature sensor, a pressure sensor, a humidity sensor, a gas sensor, or multiples of any such sensors. In other embodiments, environmental sensor(s) 104 includes only a single environmental sensor. In some embodiments, MEMS microphone 102 may be implemented as any acoustic MEMS transducer. For example, MEMS microphone 102 may be a microphone or a microspeaker. In another embodiment, for ultrasound applications the acoustic MEMS transducer may be used as both a speaker and a microphone. Various embodiment configurations are described further herein below in reference to the other figures.

Figure 2A:
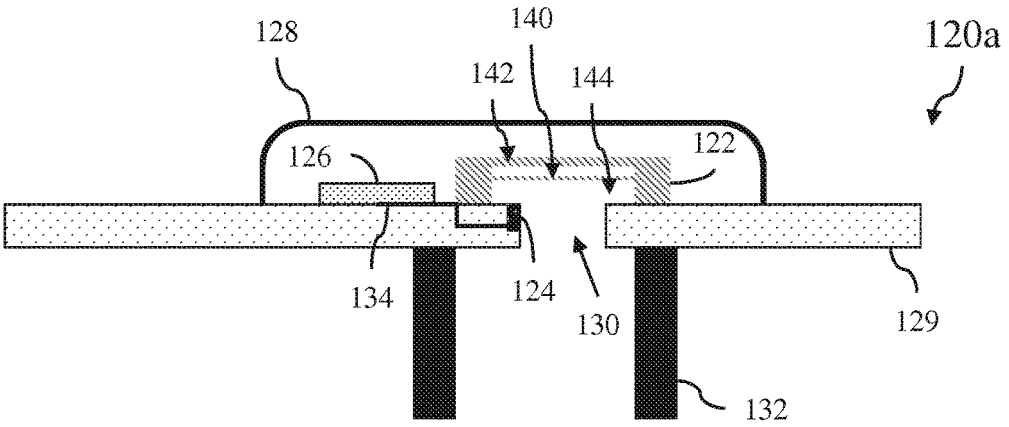
FIGS. 2*a*, 2*b*, 2*c*, 2*d*, 2*e*, 2*f*, and 2*g* illustrate schematic cross-sections of further embodiment transducer packages.

FIGS. 2*a*, 2*b*, 2*c*, 2*d*, 2*e*, 2*f*, and 2*g* illustrate schematic cross-sections of further embodiment transducer packages. FIG. 2*a* illustrates transducer package 120*a* including MEMS microphone 122, environmental sensor 124, ASIC 126, lid 128, circuit board 129, and port structure 132. According to various embodiments, MEMS microphone 122 and environmental sensor 124 are coupled to ASIC 126, which includes shared circuit elements and dedicated circuit elements for MEMS microphone 122 and environmental sensor 124.

In various embodiments, circuit board 129 includes port 130. Together, port 130 in circuit board 129 and port structure 132 allow transmission of environmental signals through to MEMS microphone 122 and environmental sensor 124. Environmental signals may include acoustic signals propagating through a fluidic medium, such as air, temperature signals of the fluidic medium, pressure signals of the fluidic medium, humidity signals related to the fluidic medium, and chemical signals of gases in the fluidic medium. Thus, port 130 and port structure 132 allow transmission of fluidic signals from an ambient environment to MEMS microphone 122 and environmental sensor 124. Corresponding to such environmental signals, environmental sensor 124 includes a temperature sensor, a pressure sensor, a humidity sensor, or a gas sensor, such as a carbon monoxide sensor for example, in various embodiments. In some embodiments, environmental sensor 124 includes a plurality of any such sensors. For example, environmental sensor 124 may include a temperature sensor and a humidity sensor. In another example, environmental sensor 124 may include a pressure sensor and a temperature sensor.

Various configurations are described further herein below in reference to FIGS. 4*a*-4*d*. In various embodiments, temperature sensors may be placed in the substrate of ASIC 126 or on the surface of ASIC 126. For example, temperature sensors may be included as polysilicon resistors or thermocouples. In some embodiments, there may be thermodynamic advantages if the sensor is at the surface. In some embodiments, environmental sensor 124 may include multiple temperature sensors formed in MEMS microphone 122 and ASIC 126, for example. A pressure sensor may also be integrated in CMOS and separately mounted on circuit board 129 or integrated in ASIC 126. A humidity sensor may also be integrated in ASIC 126. In the specific embodiment shown in FIG. 2*a*, environmental sensor 124 may include any such sensors, for example, and is formed or attached to circuit board 129 in port 130.

In various embodiments, MEMS microphone 122 includes membrane 140, backplate 142, and cavity 144. Membrane 140 of MEMS microphone 122 separates the space or region enclosed by lid 128 and circuit board 129 from the ambient environment available through port 130 and port structure 132. In such embodiments, acoustic signals propagate through port structure 132 and port 130 into cavity 144 in MEMS microphone 122. Such acoustic signals cause membrane 140 to deflect, which causes MEMS microphone 122 to generate transduced electrical signals based on the incident acoustic signals.

Transducer package 120*a* as shown in FIG. 2*a* includes environmental sensor 124 embedded in circuit board 129 in port 130. Thus, environmental signals are available to environmental sensor 124 through port 130 and port structure 132 in the same was as acoustic signals are available to MEMS microphone 122. In some embodiments, environmental sensor 124 may be formed as a portion of circuit board 129. In another embodiment, environmental sensor 124 is attached to circuit board 129, such as using glue or a conductive paste.

In various embodiments, circuit board 129 is a printed circuit board (PCB) that includes interconnecting conductive lines in the PCB. The interconnecting conductive lines coupled environmental sensor 124 with ASIC 126 as shown by interconnecting conductive line 134. MEMS microphone 122 is also coupled to ASIC 126 through interconnecting conductive lines (not shown) in PCB.

In various embodiments, port structure 132 corresponds to a device package, case, or housing that includes the transducer package (120*a*-120*f*). For example, the transducer package (120*a*-120*f*) may be included in a mobile phone. Port structure 132 may be a portion of the mobile phone housing that couples the transducer package (120*a*-120*f*) to the ambient environment. In some embodiments, the transducer package (120*a*-120*f*) may be included in a tablet computer or part of a larger electronic system, such as an automobile for example.

Figure 2B:
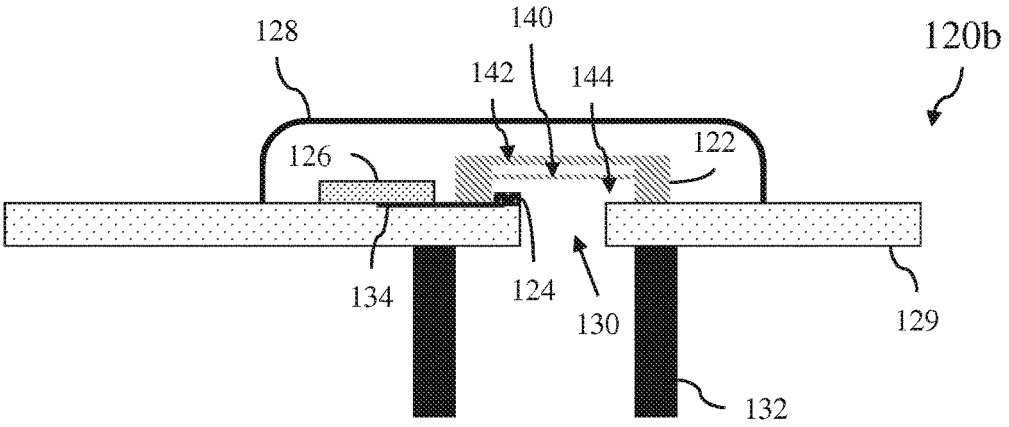

FIG. 2*b* illustrates transducer package 120*b*. According to some embodiments, environmental sensor 124 is formed or placed on circuit board 129 in cavity 144 of MEMS microphone 122. As described hereinabove, environmental signals are available to environmental sensor 124 through port structure 132 and port 130 in the same way as acoustic signals are available to MEMS microphone 122. In some embodiments, environmental sensor 124 may be formed as a portion of circuit board 129. In another embodiment, environmental sensor 124 is attached to circuit board 129, such as using glue or a conductive paste. In such embodiments, environmental sensor 124 may be attached to circuit board 129 in the same manner as ASIC 126 or MEMS microphone 122.

Figure 2C:
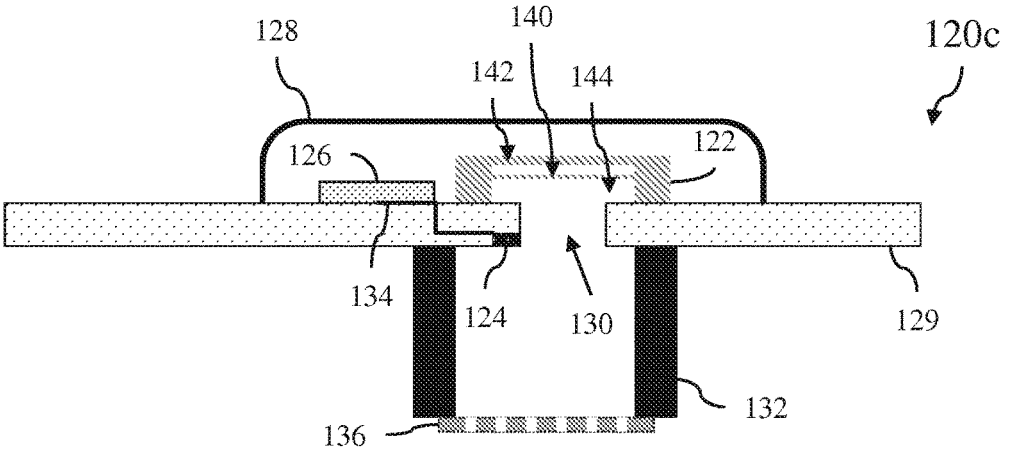

FIG. 2*c* illustrates transducer package 120*c*. According to some embodiments, environmental sensor 124 is formed or placed in or on a bottom side of circuit board 129 in port structure 132. Environmental signals are available to environmental sensor 124 through port structure 132 in the same was as acoustic signals are available to MEMS microphone 122. In some embodiments, environmental sensor 124 may be formed as a portion of circuit board 129. In another embodiment, environmental sensor 124 is attached to circuit board 129, such as using glue or a conductive paste.

According to various embodiments, transducer package 120*c* also may include barrier 136 on port structure 132. In such embodiments, barrier 136 may implement waterproofing or dust and particle protection. Barrier 136 may be a mesh formed of a polymer. In alternative embodiments, barrier 136 is a mesh formed of a metal or semiconductor material. In various embodiments, barrier 136 may be air permeable and water impermeable. In a particular embodiment, barrier 136 is liquid impermeable and gas permeable. For example, barrier 136 may prevent dust, particles, and water from entering port structure 132 while allowing air or gas to enter port structure 132 in order to be sensed by environmental sensor 124 and MEMS microphone 122. In further embodiments, barrier 136 may be perforated of micro-perforated. In an alternative embodiment, barrier 136 is liquid impermeable, gas impermeable, and deflectable for acoustic signals or pressure signals. In such embodiments, barrier 136 deflects and transfers incident pressure waves, such as acoustic signals or pressure changes, through to MEMS microphone 122 and environmental sensor 124 without allowing transfer of the fluidic medium. In various embodiments, barrier 136 may also be included in any of transducer packages 120*a*-120*f*.

Figure 2D:
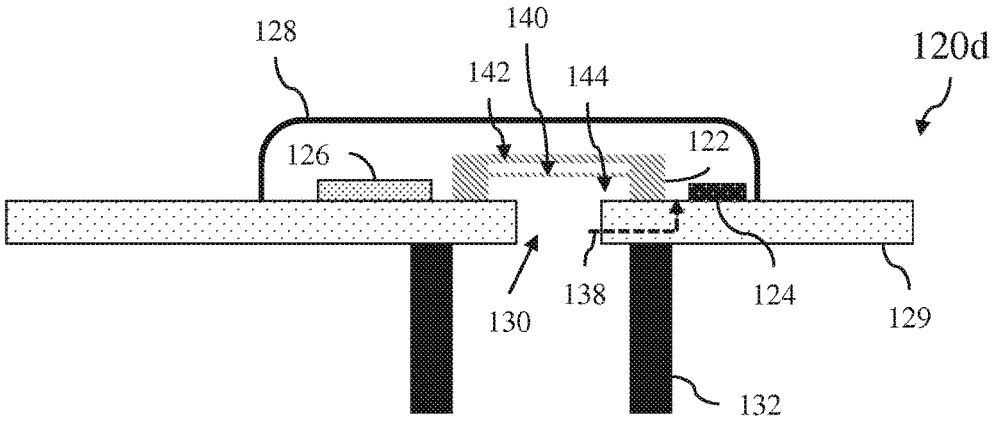

FIG. 2*d* illustrates transducer package 120*d*. According to some embodiments, environmental sensor 124 is formed or placed in or on a top side of circuit board 129 adjacent MEMS microphone 122 and enclosed by lid 128 and circuit board 129. In such embodiments, membrane 140 separates the space or region enclosed by lid 128 and circuit board 129 from the ambient environment available through port structure 132 and port 130. Thus, environmental sensor 124 is formed in the enclosed space or region and separated from the ambient environment by membrane 140.

According to various embodiments, MEMS microphone 122 includes acoustic bypass valve 138 for equalizing pressure across membrane 140. Bypass valve 138 may have a low pass filter characteristic in order to allow low frequency pressure changes to equalize across membrane 140. In such embodiments, environmental sensor 124 receives environmental signals through bypass valve 138 despite being separated from the ambient environment by membrane 140. The environmental signals measured by environmental sensor 124 may be delayed due to bypass valve 138. In various embodiments, bypass valve 138 may be formed in circuit board 129 or in the structure of MEMS microphone 122. For example, bypass valve 138 may be formed as a valve structure in circuit board 129 separate from MEMS microphone 122. In another example, bypass valve 138 is formed directly in membrane 140 of MEMS microphone 122.

Figure 2E:
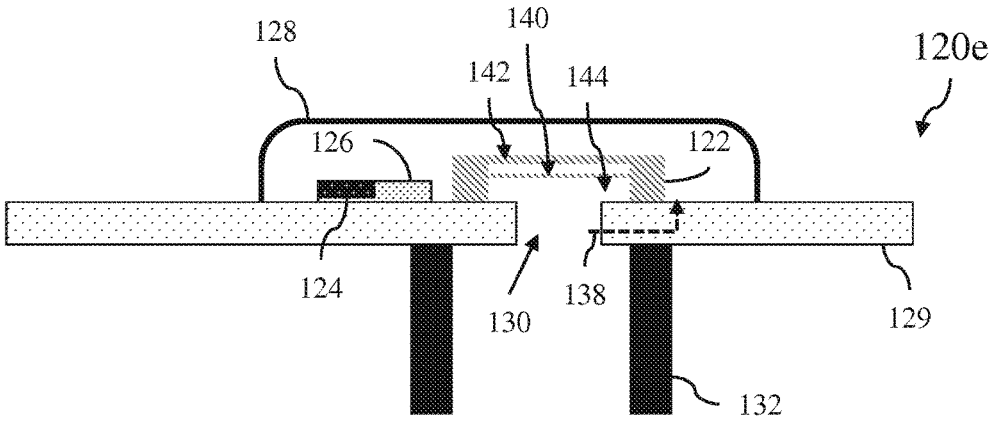

FIG. 2*e* illustrates transducer package 120*e*. According to some embodiments, environmental sensor 124 is integrated in ASIC 126. In such embodiments, ASIC 126 and environmental sensor 124 are formed on a same microfabricated die and attached to circuit board 129. In an alternative embodiment, ASIC 126 and environmental sensor 124 are formed on separate microfabricated dies and arranged on circuit board 129 as a die stack. As described hereinabove in reference to transducer package 120*d* in FIG. 2*d*, transducer package 120*e* may include bypass valve 138, which allows transmission of environmental signals from the ambient environment to environmental sensor 124.

Figure 2F:
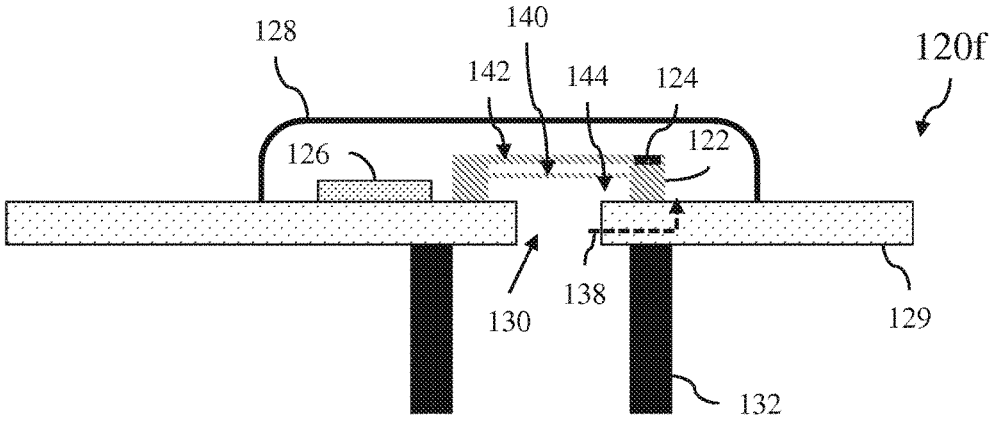

FIG. 2*f* illustrates transducer package 120*f*. According to some embodiments, environmental sensor 124 is integrated in MEMS microphone 122. In such embodiments, MEMS microphone 122 and environmental sensor 124 are formed on a same microfabricated die and attached to circuit board 129. As described hereinabove in reference to transducer package 120*d* in FIG. 2*d*, transducer package 120*f* may include bypass valve 138, which allows transmission of environmental signals from the ambient environment to environmental sensor 124.

Figure 2G:
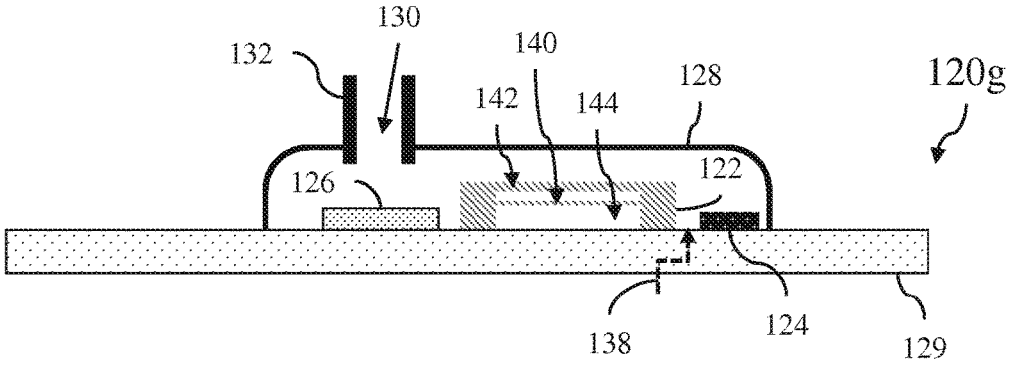

FIG. 2*g* illustrates transducer package 120*g*. According to some alternative embodiments, port 130 and port structure 132 may be formed in lid 128 instead of circuit board 129. Transducer package 120*g* includes environmental sensor 124 formed or placed in or on a top side of circuit board 129. In other embodiments, environmental sensor 124 may be formed or placed as described hereinabove in reference to any of FIGS. 2*a*-2*f*, with port 130 formed in lid 128. Further, cavity 144 may be expanded with a larger back volume (not shown) in some embodiments. In some embodiments, a barrier or water proofing mesh may also be included on or in port structure 132 as described hereinabove in reference to barrier 136.

In reference to FIGS. 2*a*-2*g*, description of commonly numbered elements applies to each element with a common reference numeral. Thus, description of each commonly numbered element is not repeated for each of FIGS. 2*a*-2*g* for the sake of brevity. Although FIGS. 2*a*-2*g* are described with reference to MEMS microphone 122, a MEMS microspeaker may also be implemented in place of, or in combination with, MEMS microphone 122 in some embodiments. Further, in particular embodiments, any of transducer packages 2*a*-2*g* may include a plurality of environmental sensors having any of the configurations shown in FIGS. 2*a*-2*g*. Thus, various embodiments may include any combination of the embodiments described herein.

Figure 3:
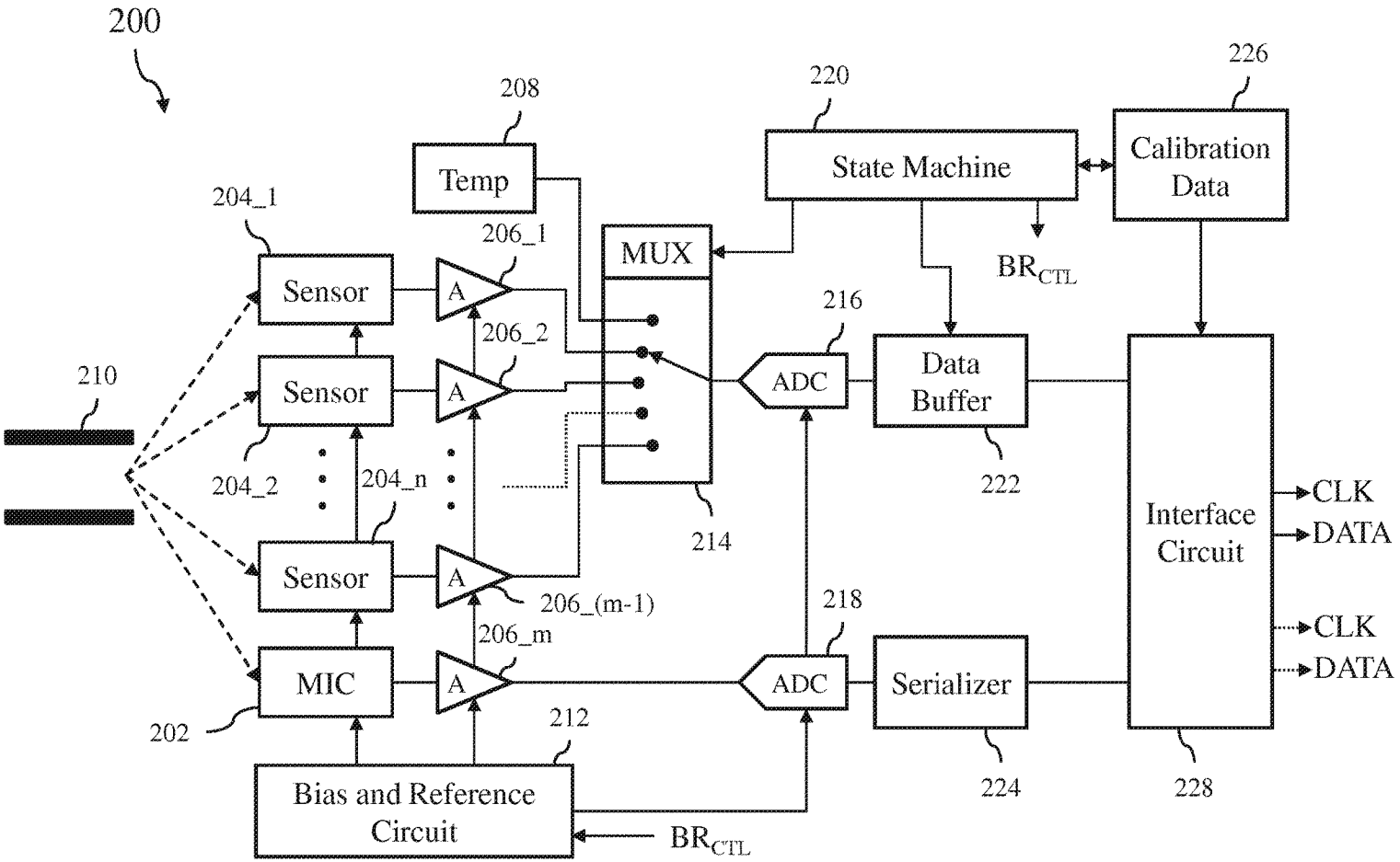
FIG. 3 illustrates a schematic diagram of an embodiment transducer system.

FIG. 3 illustrates a schematic diagram of an embodiment transducer system 200 including MEMS microphone 202, environmental sensors 204_1-204_*n*, amplifiers 206_1-206_*m*, temperature sensor 208, bias and reference circuit 212, multiplexer 214, analog to digital converter (ADC) 216, ADC 218, state machine 220, data buffer 222, serializer 224, calibration data memory 226, and interface circuit 228. According to various embodiments, transducer system 200 is included in a single transducer package, such as described hereinabove in reference to FIGS. 1 and 2*a*-2*g*, for example, and may be implemented on a first microfabricated die with circuit elements and a second microfabricated die with sensor elements. Some sensor elements may be formed on a same microfabricated die as the circuit elements. In various embodiments, some circuit blocks are shared by environmental sensors 204_1-204_*n* and MEMS microphone 202.

According to various embodiments, port 210 allows transmission of environmental signals from the ambient environment to environmental sensors 204_1-204_*n*, MEMS microphone 202, and temperature sensor 208. Transducer system 200 may include any number n of environmental sensors 204_1-204_n. In embodiments where only a single environmental sensor 204_1 is included, the other environmental sensors and corresponding amplifiers 206_2-206_(m-1) are omitted. Amplifiers 206_1-206_m are coupled to sensors 204_1-204_n and MEMS microphone 202 and amplify transduced signals from sensors 204_1-204_n and MEMS microphone 202. Transducer system 200 may include any number m of amplifiers 206_1-206_m. For example, m may be set equal to n+1 in order to provide an amplifier for each environmental sensor 204_1-204_n and MEMS microphone 202. In other embodiments, amplifier 206_1 is coupled to an output of multiplexer 214 and amplifiers 206_2-206_(m-1) are omitted. In such embodiments, amplification is performed after multiplexing signals from environmental sensors 204_1-204_n.

According to various embodiments, multiplexer 214 receives transduced and amplified signals from environmental sensor 204_1-204_n as well as a transduced temperature signal from temperature sensor 208. In alternative embodiments, temperature sensor 208 may be omitted. Multiplexer 214 receives a select signal from state machine 220 in order to select one of the signals from environmental sensor 204_1-204_n and temperature sensor 208 and output the selected signal to ADC 216. ADC 218 also receives a transduced and amplified signal from MEMS microphone 202 and amplifier 206_m. Both ADC 216 and ADC 218 convert the transduced analog signals into digital signals. ADC 216 provides a digital output signal to data buffer 222, which interfaces with interface circuit 228. In some embodiments, data buffer 222 may be a first in first out (FIFO) buffer. Similarly, ADC 218 provides a digital output signal to serializer 224, which also interfaces with interface circuit 228. In some embodiments, serializer 224 may arrange the digital data in a serial data stream with pulse density modulation (PDM). In various embodiments, other interfaces approaches may be used between ADC 216 and ADC 218 and interface circuit 228.

In various embodiments, interface circuit 228 may include any number of serial or parallel interfaces. For example, a serial interface having a data line DATA and a separate synchronous clock line CLK is shown. Interface circuit 228 may output data from environmental sensors 204_1-204_n and temperature sensor 208 to a first processing circuit (not shown) and may output data from MEMS microphone 202 to a second processing circuit (not shown). For example, the first processing circuit may be an environmental monitoring and processing circuit while the second processing circuit may be an audio processing circuit, such as a CODEC. In other embodiments, a single processing circuit, such as a digital signal processor (DSP), may process environmental signals and acoustic signals.

In various embodiments, state machine 220 provides select signals to multiplexer 214, control signals to data buffer 222, and bias and reference control BRCTL to bias and reference circuit 212. Calibration data memory 226 is a memory block that stores calibration data for calibrating transducer system 200. Calibration data memory 226 may be implemented as a non-volatile memory (NVM) block. In various embodiments, calibration data memory 226 communicates calibration data with state machine 220 and interface circuit 228. Environmental sensors 204_1-204_n may be configured using synchronous clock line CLK and data line DATA from interface circuit 228, calibration data 226, and state machine 220. In such embodiments, transducer system 200 may operate in different operating modes such as power down, low power, high data rate, low data rate, single measurements, or others. Synchronous clock line CLK and data line DATA may be used to specify the operating modes in such embodiments.

According to various embodiments, environmental sensors 204_1-204_n, MEMS microphone 202, ADC 216, and ADC 218 share bias and reference circuit 212, state machine 220, calibration data memory 226, and interface circuit 228. Further, temperature sensor 208 and environmental sensors 204_1-204_n share ADC 216 and data buffer 222. This may lead to decreased space usage for embodiment transducer system 200. In some embodiments, ADC 216 and ADC 218 are maintained separate in order to allow for a higher data rate in MEMS microphone 202 compared to environmental sensors 204_1-204_n and temperature sensor 208. In other embodiments, MEMS microphone 202 and amplifier 206_m may also be coupled to multiplexer 214 and ADC 218 may be omitted, resulting in further space savings. In another embodiment, an analog output signal from the output of amplifier 206_m may be provided as an output of transducer system 200. In such embodiments, ADC 218 and serializer 224 may be omitted. In some embodiments, transducer system 200 may include analog outputs in addition to a digital interface.

Figure 4A:
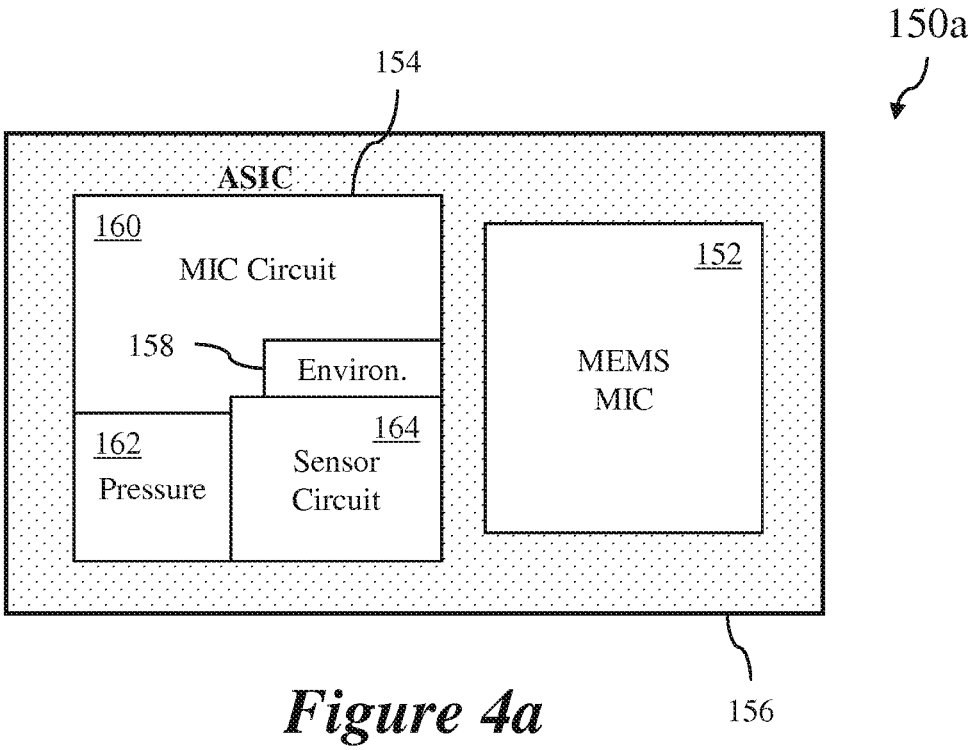
FIGS. 4*a*, 4*b*, 4*c*, and 4*d* illustrate schematic block diagrams of additional embodiment transducer packages.

FIGS. 4a, 4b, 4c, and 4d illustrate schematic block diagrams of additional embodiment transducer packages 150a, 150b, 150c, and 150d with embodiment sensor configurations. FIG. 4a illustrates transducer package 150a including MEMS microphone 152 and ASIC 154 attached to circuit board 156. According to various embodiments, ASIC 154 includes environmental sensor 158, pressure sensor 162, sensor circuit 164, and microphone circuit 160. MEMS microphone 152 is coupled to ASIC 154 through circuit board 156. In such embodiments, environmental sensor 158 and pressure sensor 162 are monolithically integrated in ASIC 154 with microphone circuit 160 and sensor circuit 164. For example, environmental sensor 158 may be implemented as described hereinabove in reference to environmental sensor 124 in FIG. 2e.

According to various embodiments, sensor circuit 164 includes circuit blocks shared by environmental sensor 158 and pressure sensor 162. Further, MEMS microphone 152 may also share circuit blocks from sensor circuit 164. Microphone circuit 160 includes circuit blocks that are dedicated to MEMS microphone 152 and are not shared. In various embodiments, environmental sensor 158 may include a humidity sensor or a gas sensor, for example. In other embodiments, environmental sensor 158 is a temperature sensor.

Figure 4B:
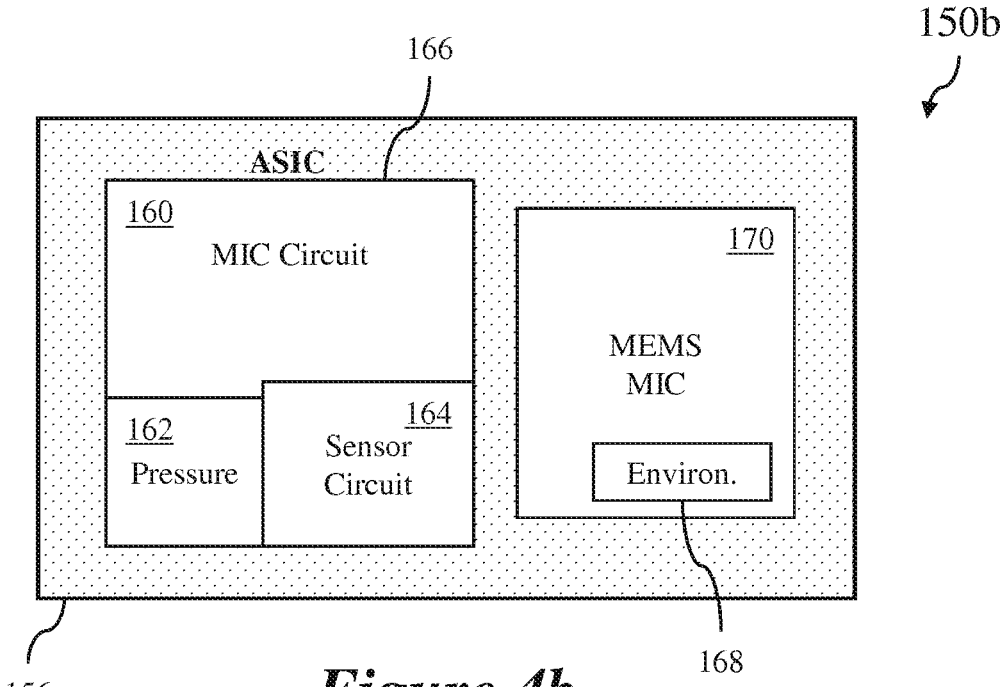

FIG. 4b illustrates transducer package 150b including MEMS microphone 170 and ASIC 166 attached to circuit board 156. According to various embodiments, environmental sensor 168 is adjacent, beneath, or integrated with MEMS microphone 170. In such embodiments, MEMS microphone 170 and environmental sensor 168 are located near a shared port in circuit board 156. For example, environmental sensor 168 may be implemented as described hereinabove in reference to environmental sensor 124 in FIGS. 2a, 2b, 2c, 2d, and 2f. ASIC 166 includes microphone circuit 160, monolithically integrated pressure sensor 162, and sensor circuit 164. In various embodiments, environmental sensor 168 may include a humidity sensor or a gas sensor, for example. In other embodiments, environmental sensor 168 is a temperature sensor.

Figure 4C:
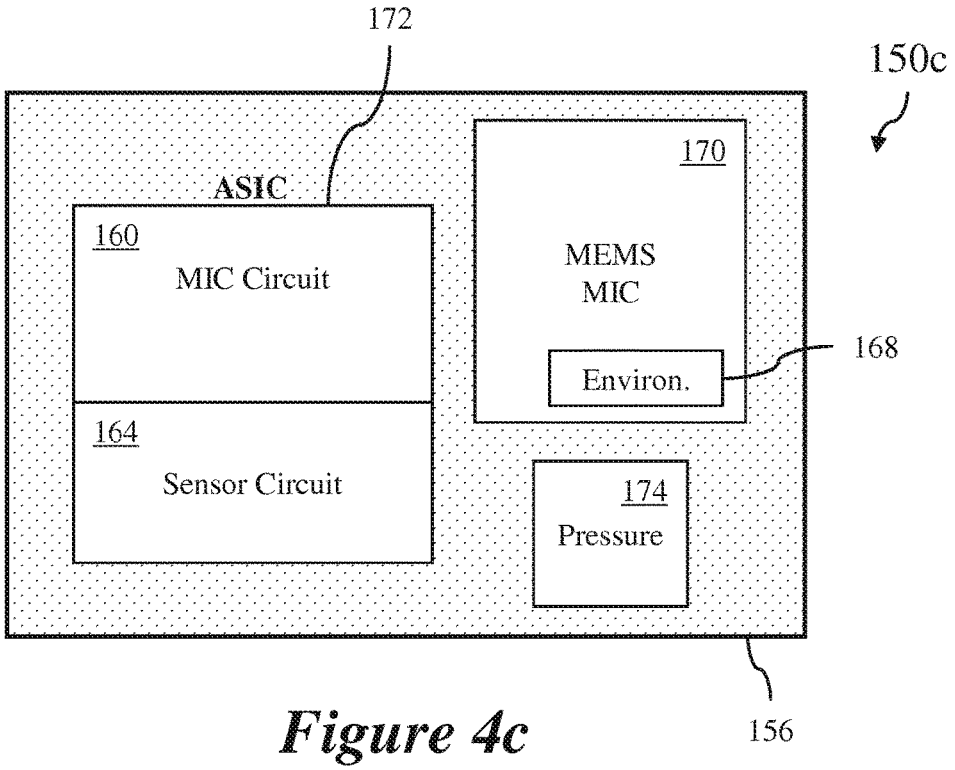

FIG. 4c illustrates transducer package 150c including MEMS microphone 170, ASIC 172, and pressure sensor 174 attached to circuit board 156. According to various embodiments, pressure sensor 174 is formed as a separate microfabricated die and attached to circuit board 156. In such embodiments, pressure sensor 174, MEMS microphone 170, and environmental sensor 168 are located near a shared port in circuit board 156. ASIC 172 includes microphone circuit 160 and sensor circuit 164.

Figure 4D:
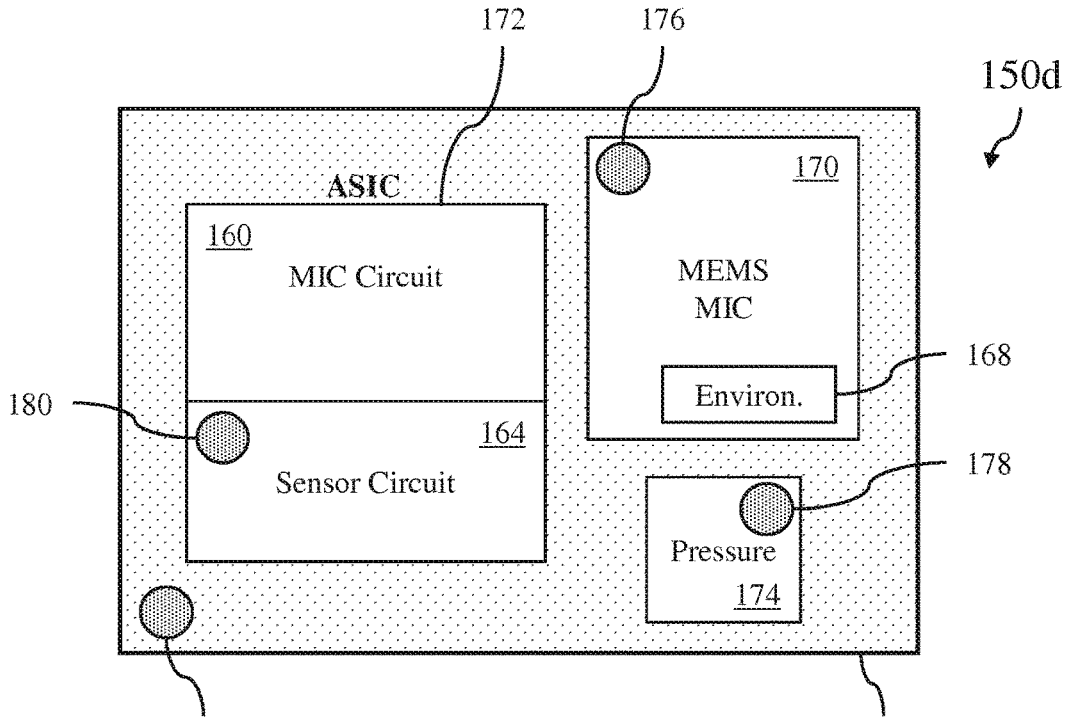

FIG. 4*d* illustrates transducer package 150*d* including MEMS microphone 170, ASIC 172, and pressure sensor 174 attached to circuit board 156. According to various embodiments, transducer package 150*d* is similar to transducer package 150*c*, with the addition of temperature sensors 176, 178, 180, and 182. In some embodiments, any number of temperature sensors may be included and some of temperature sensors 176, 178, 180, and 182 may be omitted. For example, temperature sensor 180 in ASIC 172 and temperature sensor 176 in MEMS microphone 170 are included while temperature sensor 178 in pressure sensor 174 and temperature sensor 182 on circuit board 156 are omitted in one embodiment. Temperature sensors 176, 178, and 180 may be monolithically integrated temperature sensors formed in microfabricated dies with MEMS microphone 170, pressure sensor 174, and ASIC 172, respectively.

In various embodiments, numerous configurations and integrations of environmental sensors and acoustic transducers are possible. For example, multiple environmental sensors may be used and integrated in an ASIC, integrated in a MEMS microphone, or separately attached to a shared circuit board beneath or adjacent the MEMS microphone. In other embodiments, a MEMS microspeaker is used in addition to or in place of the MEMS microphone. Description of each commonly numbered element is not repeated for each of FIGS. 4*a*-4*d* for the sake of brevity as each description applies to each element with a common reference numeral.

Figure 5:
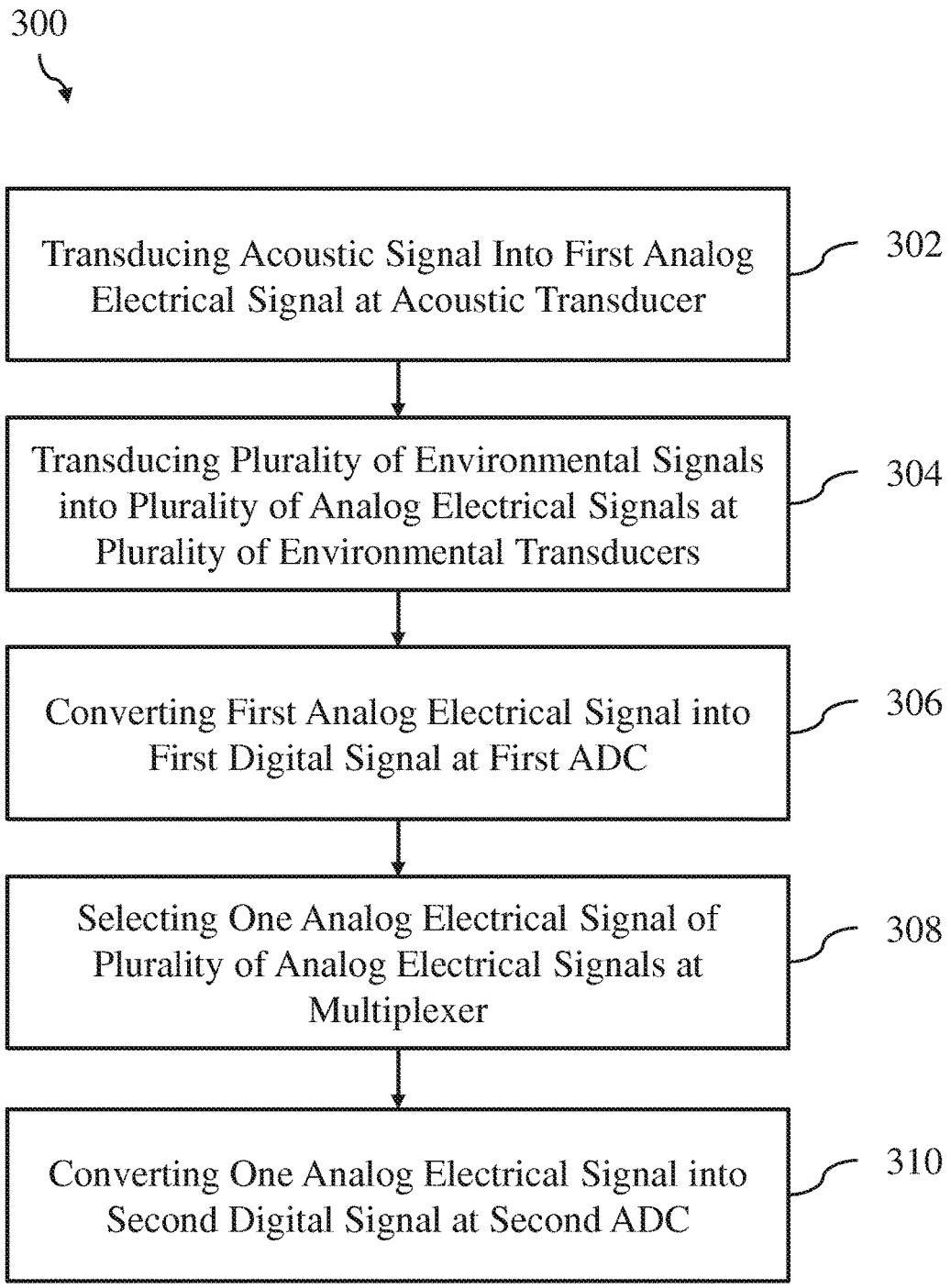
FIG. 5 illustrates a block diagram of an embodiment method of operation for a transducer system.

FIG. 5 illustrates a block diagram of an embodiment method of operation 300 for a transducer system. According to various embodiments, method of operation 300 is a method of operating a transducer system including steps 302, 304, 306, 308, and 310. Step 302 includes transducing an acoustic signal into a first analog electrical signal at an acoustic transducer. Step 304 includes transducing a plurality of environmental signals into a plurality of analog electrical signals at a plurality of environmental transducers. In various embodiments, following steps 302 and 304, step 306 includes converting the first analog electrical signal into a first digital signal at a first analog to digital converter (ADC). In other embodiments, step 306 may be omitted along with the first ADC. In such embodiments, the first analog electrical signal may be an analog output. For example, the transduced acoustic signal may be amplified and output to a processing device as an amplified analog signal, without digital conversion. Step 308 includes selecting one analog electrical signal of the plurality of analog electrical signals at a multiplexer. Step 310 includes converting the one analog electrical signal into a second digital signal at a second ADC. The first and second digital signals may then be provided through an interface circuit to an application processor or digital signal processor (DSP). In embodiments omitting step 306, the first analog electrical signal may be output with the second digital signal, thus providing an analog acoustic output signal and a digital environmental output signal. The multiplexer may select different signal from the plurality of analog electrical signals in order to cycle the signals from the plurality of environmental transducers over time. In other embodiments, step 306 may be omitted. In such embodiments, the outputs include an analog acoustic signal and a digital representation of one or more environmental signals.

According to an embodiment, a transducer package includes a circuit board including a port, a lid disposed over the port, an acoustic transducer disposed over the port and including a membrane, and an environmental transducer disposed at the circuit board in the port. The lid encloses a first region, and the membrane separates the port from the first region. Other embodiments include corresponding systems, apparatus, and structures, each configured to perform the actions or steps of corresponding embodiment methods.

In various embodiments, the environmental transducer may be disposed on a top side of the circuit board in a cavity of the acoustic transducer. In other embodiments, the environmental transducer may be disposed in the circuit board. In some embodiments, the transducer package further includes a housing structure coupled to the circuit board, where the port is fluidically coupled with an ambient environment through an opening in the housing structure. In such embodiments, the transducer package may further include a protective structure arranged in the opening in the housing structure between the port and the ambient environment. The protective structure includes a mesh that is water impermeable in some embodiments.

In various embodiments, the transducer package further includes an integrated circuit disposed on the circuit board and coupled to the acoustic transducer and the environmental transducer. The integrated circuit may include shared circuit blocks coupled to both the acoustic transducer and the environmental transducer and dedicated circuit blocks coupled only to the acoustic transducer. In some embodiments, the environmental transducer includes a plurality of environmental transducers. The environmental transducer may include a sensor selected from a group including a humidity sensor, a pressure sensor, a temperature sensor, and a gas sensor.

According to an embodiment, a transducer system includes an acoustic transducer in fluid communication with an external port, a plurality of environmental transducers in fluid communication with the external port, an analog amplifier coupled to the acoustic transducer, a first analog to digital converter (ADC), and a multiplexer with a plurality of inputs and an output. The plurality of inputs are respectively coupled to the plurality of environmental transducers and the output is coupled to the first ADC. Other embodiments include corresponding systems, apparatus, and structures, each configured to perform the actions or steps of corresponding embodiment methods.

In various embodiments, the transducer system further includes a second ADC coupled to the analog amplifier. The transducer system may further include a single reference voltage circuit coupled to the acoustic transducer and the plurality of environmental transducers. In some embodiments, the first ADC, the second ADC, the multiplexer, and the single reference voltage circuit are formed on a same integrated circuit. In such embodiments, an environmental transducer of the plurality of environmental transducers may be formed on the same integrated circuit.

In various embodiments, the transducer system further includes an interface circuit, where the interface circuit is configured to output an analog acoustic signal from the analog amplifier and a digital environmental signal from the first ADC. In some embodiments, the acoustic transducer includes a MEMS microphone. Each environmental transducer of the plurality of environmental transducers includes a sensor selected from a group including a microfabricated humidity sensor, a microfabricated pressure sensor, a microfabricated temperature sensor, and a microfabricated gas sensor.

In various embodiments, the transducer system further includes a printed circuit board (PCB), where the PCB includes a port formed in the PCB that is in fluid communication with the external port, and the acoustic transducer is disposed over the port in the CPB. In some embodiments, an environmental transducer of the plurality of environmental transducers is directly attached to the PCB. In a specific embodiment, the environmental transducer of the plurality of environmental transducers is directly attached to the PCB in the port in the PCB. In further embodiments, an environmental transducer of the plurality of environmental transducers is integrated in the acoustic transducer.

According to an embodiment, a method of operating a transducer system includes transducing an acoustic signal into a first analog electrical signal at an acoustic transducer, transducing a plurality of environmental signals into a plurality of analog electrical signals at a plurality of environmental transducers, selecting one analog electrical signal of the plurality of analog electrical signals at a multiplexer, and converting the one analog electrical signal into a first digital signal at a first analog to digital converter (ADC). Other embodiments include corresponding systems, apparatus, and structures, each configured to perform the actions or steps of corresponding embodiment methods.

In various embodiments, the method further includes converting the first analog electrical signal into a second digital signal at a second ADC. In other embodiments, the method further includes providing the first analog electrical signal at an analog output and providing the first digital signal at a digital output. In some embodiments, transducing a plurality of environmental signals includes sensing a plurality of environmental signals from a group including humidity signals, pressure signals, temperature signals, and gas signals, and generating the plurality of analog electrical signals based on the plurality of environmental signals.

In various embodiments, the method further includes receiving the acoustic signal and the plurality of environmental signals through a shared port. The method may further include amplifying the first analog electrical signal and the plurality of analog electrical signals. In some embodiments, the method further includes biasing the acoustic transducer and the plurality of environmental transducers with a bias circuit in a shared interface integrated circuit.

According to an embodiment, a transducer package includes a circuit board, a lid disposed on the circuit board, a port formed in the circuit board or the lid, an acoustic transducer disposed on the circuit board and including a membrane, and an integrated circuit die disposed on the circuit board. The membrane is in fluid communication with an ambient environment through the port. In such embodiments, the integrated circuit die includes an environmental transducer formed in the integrated circuit die, a shared interface circuit coupled to the environmental transducer and the acoustic transducer, and an acoustic circuit coupled to only the acoustic transducer. The environmental transducer is in fluid communication with the ambient environment through the port. Other embodiments include corresponding systems, apparatus, and structures, each configured to perform the actions or steps of corresponding embodiment methods.

In various embodiments, the environmental transducer includes a pressure sensor. The environmental transducer may further include a temperature sensor, a humidity sensor, or a gas sensor. In some embodiments, the transducer package further includes a protective structure arranged between the port and the ambient environment. The protective structure may include a mesh that is water impermeable.

According to various embodiments described herein, advantages may include space savings along with additional functionality in transducer systems. In some embodiments, multiple transducers share circuit blocks in a corresponding ASIC, leading to semiconductor space saving. In various embodiments, multiple transducers are packaged in a single transducer package and share a common port in the package, leading to circuit board space saving and reduced packaging efforts associated with multiple ports. In various embodiments, the sensors share the opening of the package and the opening in the device, such as a phone, tablet, or other device, for example. Advantages of such embodiments may include reduced space cost and improved robustness of the device. For example, shared openings may be especially advantages for water-proof devices.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A transducer system comprising:

an acoustic transducer in fluid communication with an external port;

a plurality of environmental transducers in fluid communication with the external port;

an analog amplifier coupled to the acoustic transducer;

a first analog to digital converter (ADC);

a multiplexer with a plurality of inputs and an output, wherein the plurality of inputs are respectively coupled to the plurality of environmental transducers and the output is coupled to the first ADC;

a second ADC coupled to the analog amplifier; and a single reference voltage circuit coupled to the acoustic transducer and the plurality of environmental transducers.

2. The transducer system of claim 1, wherein the first ADC, the second ADC, the multiplexer, and the single reference voltage circuit are formed on a same integrated circuit.

3. The transducer system of claim 2, wherein an environmental transducer of the plurality of environmental transducers is formed on the same integrated circuit.

4. The transducer system of claim 1, further comprising an interface circuit, wherein the interface circuit is configured to output an analog acoustic signal from the analog amplifier and a digital environmental signal from the first ADC.

5. The transducer system of claim 1, wherein the acoustic transducer comprises a MEMS microphone.

6. The transducer system of claim 1, wherein each environmental transducer of the plurality of environmental transducers comprises a sensor selected from a group comprising a microfabricated humidity sensor, a microfabricated pressure sensor, a microfabricated temperature sensor, and a microfabricated gas sensor.

7. The transducer system of claim 1, further comprising a printed circuit board (PCB), wherein the PCB comprises a port formed in the PCB that is in fluid communication with the external port, and the acoustic transducer is disposed over the port in the PCB.

8. The transducer system of claim 7, wherein an environmental transducer of the plurality of environmental transducers is directly attached to the PCB.

9. The transducer system of claim 8, wherein the environmental transducer of the plurality of environmental transducers is directly attached to the PCB in the port in the PCB.

10. The transducer system of claim 7, wherein an environmental transducer of the plurality of environmental transducers is integrated in the acoustic transducer.

11. A transducer system comprising:

an acoustic transducer in fluid communication with an external port;

a plurality of environmental transducers in fluid communication with the external port;

an analog amplifier coupled to the acoustic transducer;

a first analog to digital converter (ADC);

a multiplexer with a plurality of inputs and an output, wherein the plurality of inputs are respectively coupled to the plurality of environmental transducers and the output is coupled to the first ADC; and a printed circuit board (PCB), wherein the PCB comprises a port formed in the PCB that is in fluid communication with the external port, and wherein the acoustic transducer is disposed over the port in the PCB.

12. The transducer system of claim 11, wherein an environmental transducer of the plurality of environmental transducers is directly attached to the PCB.

13. The transducer system of claim 12, wherein the environmental transducer of the plurality of environmental transducers is directly attached to the PCB in the port in the PCB.

14. The transducer system of claim 11, wherein an environmental transducer of the plurality of environmental transducers is integrated in the acoustic transducer.

15. The transducer system of claim 11, further comprising an interface circuit, wherein the interface circuit is configured to output an analog acoustic signal from the analog amplifier and a digital environmental signal from the first ADC.

16. The transducer system of claim 11, wherein the acoustic transducer comprises a MEMS microphone.

17. The transducer system of claim 11, wherein each environmental transducer of the plurality of environmental transducers comprises a sensor selected from a group comprising a microfabricated humidity sensor, a microfabricated pressure sensor, a microfabricated temperature sensor, and a microfabricated gas sensor.

* * * * *